United States Patent [19]

Mayer et al.

[11] 4,119,309

[45] Oct. 10, 1978

[54] DEVICE FOR THE FLATTENING OF SHEETS BY MEANS OF SUCTION

[75] Inventors: Peter Mayer; Claus Simeth, both of Muhlheim, Fed. Rep. of Germany

[73] Assignee: Roland Offsetmaschinenfabrik Faber & Schleicher AG, Offenbach, Fed. Rep. of Germany

[21] Appl. No.: 844,905

[22] Filed: Oct. 25, 1977

[30] Foreign Application Priority Data

Oct. 28, 1976 [DE] Fed. Rep. of Germany ..... 2649051

[51] Int. Cl.[2] ..... B65H 29/68

[52] U.S. Cl. ..... 271/183; 72/54; 72/160; 162/271; 264/101; 425/388

[58] Field of Search ..... 226/195; 271/63, 183; 162/270, 271, 197; 38/14; 425/388; 264/101, 90; 72/54, 160

[56] References Cited

U.S. PATENT DOCUMENTS

| | | | |
|---|---|---|---|
| 2,531,619 | 11/1950 | Gonia | 162/270 |
| 4,013,284 | 3/1977 | Demetre | 271/63 X |
| 4,060,236 | 11/1977 | Carstedt | 271/183 |

*Primary Examiner*—Richard A. Schacher

*Attorney, Agent, or Firm*—Leydig, Voit, Osann, Mayer & Holt, Ltd.

[57] ABSTRACT

A device for removing curling tendency in sheets, particularly sheets fed to printing presses, in which the sheets are conveyed over two beam-like supporting members arranged transversely with respect to the direction of sheet movement and presenting supporting surfaces which are spaced parallel to one another on one side of the sheet to define a groove in between them. Suction is applied within the groove to draw a passing sheet downwardly into the groove to produce a relatively sharp concave bend in the sheet thereby to counteract the curling tendency. The cross-sectional profile of the groove is variable by a movable member to vary the profile of the groove and hence the degree of sharpness of the bend, thereby permitting the degree of correction to be varied while keeping the suction substantially constant. The device, in both preferred and alternate embodiments, has provision for removing curling tendency in opposite directions.

10 Claims, 7 Drawing Figures

DEVICE FOR THE FLATTENING OF SHEETS BY MEANS OF SUCTION

The sheets fed from a printing unit in a printing press have a tendency to curl because of the bending of the sheet in the press and the unlike amount of ink and moisture, particularly the latter, existing on the opposite sides of the sheet. Most often the sheets tend to be upwardly convex when deposited upon a delivery pile causing "rolling in" of the leading and trailing edges which interferes with orderly stacking. Devices are available on the market to correct this curling tendency, an example being that shown in German Offenlegungsschrift No. 2,345,900 published Nov. 28, 1974.

Prior devices have, however, certain limitations and drawbacks. It is obviously desirable to vary the corrective effect depending upon whether the curling tendency is great or only slight. This has been generally accomplished in the past by varying the degree of vacuum. However, it is found that under conditions of slight vacuum retention of a sheet in contact with the de-curling device is unreliable and sheets may pass the device without being subjected to corrective action. Moreover, conventional sheet-flattening devices as represented by the above German application are capable of producing corrective action in one direction only, for example, that where the curling tendency is upwardly convex, while being completely ineffective or disadvantageous in the case of curling tendency in the opposite direction.

It is, accordingly, an object of the present invention to provide a device for removing curling tendency in which the degree of correction is variable over a wide range without reliance upon variations in vacuum and while keeping the degree of vacuum relatively constant. Thus, it is an object of the invention to provide a decurling, or sheet-flattening, device in which each sheet is acted upon reliably and to the proper degree regardless of the amount of correction for which the device has been set.

It is another object of the invention to provide a decurling device capable of operating upon sheets fed along a transport path in quick succession and which is easily and quickly adjustable, even while the device is in operation, to change the amount of correction being imparted to the sheets.

It is another object of the present invention to provide a decurling device which, unlike conventional devices, is capable of counteracting a curling tendency regardless of whether convex of concave, simply by shifting the relative positions of the parts of which the device is constructed.

It is also an object of the present invention to provide a device for removing curling tendency in sheets which is economical to construct and install and which may be simply operated by a pressman without substantial skill or experience, the device being adjustable in one direction or the other until it is noted that the sheets are being deposited upon the delivery pile in the desired, substantially flat condition.

Other objects and advantages of the invention will become apparent upon reading the attached detailed description and upon reference to the drawings in which:

FIG. 1 shows the cross-section of a decurling device constructed in accordance with the invention;

FIG. 1*a* shows the device with the component parts in exploded relation;

While the invention has been directed in connection with certain preferred embodiments of the device, it will be understood that we do not intend to be limited to the particular embodiments which have been illustrated, but intend, on the contrary, to cover the various alternative and equivalent forms of the invention covered within the spirit and scope of the appended claims.

Figure 1:
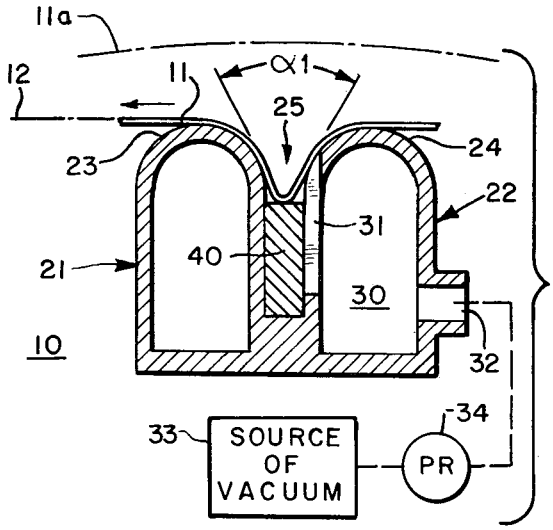

Turning now to FIG. 1, there is shown a decurling device 10 acting upon a sheet 11 which is conveyed, by grippers or the like, in a transport plane 12, to a delivery pile (not shown). The device 10, while not shown in a top view, will be understood to extend the full width of the sheet transversely with respect to the direction of sheet movement. The device is made up of a pair of beam-like supporting members, specifically a downstream supporting member 21 and an upstream supporting member 22, presenting, to the sheet, supporting surfaces 23, 24 which are spaced parallel to one another on one side of the transport plane 12. The supporting surfaces 23, 24 are preferably smoothly curved to present cylindrical crown surfaces having a preferably large radius of curvature, that is, a radius of curvature which is sufficiently large so that the supporting surfaces do not per se impart a "set" to the sheet by causing the sheet to be stressed, in curvature, beyond its elastic limit. The two supporting surfaces 23, 24 are laterally spaced to define between them a groove 25.

Means are provided for applying vacuum for drawing a passing sheet downwardly into the groove where the sheet undergoes a sharp bend, that is, a bend at a radius sufficiently small so as to stress the sheet beyond its elastic limit thereby to impart a "set" to the sheet or, more particularly, to remove, or counteract, the set in the sheet which brings about the curling tendency. To apply vacuum along the entire length of the groove 25, the supporting member 22 is hollowed out, as indicated at 30, to form a longitudinally extending plenum which communicates with the groove 25 by means of a series of horizontally spaced slit-like openings 31 which extend substantially the depth of the groove. The vacuum is applied to the space 30 by a line 32 leading to a source of vacuum 33. Interposed in the line is a pressure regulator valve 34 which serves to maintain the level of vacuum substantially constant; indeed, it is one of the features of the present invention that the vacuum may remain substantially constant while the degree of curling correction is variable over wide limits.

Figure 2:
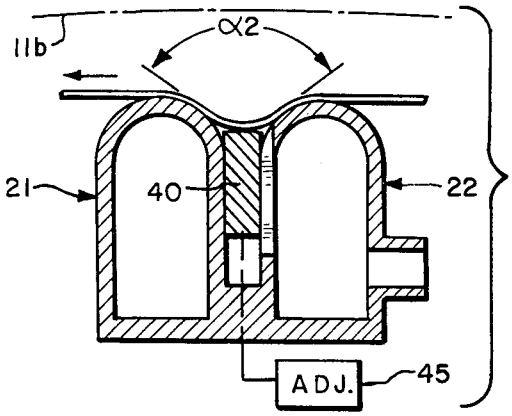
FIG. 2 is a view similar to FIG. 1 but showing a device adjusted to produce a more limited degree of curling correction.
Figure 1A:
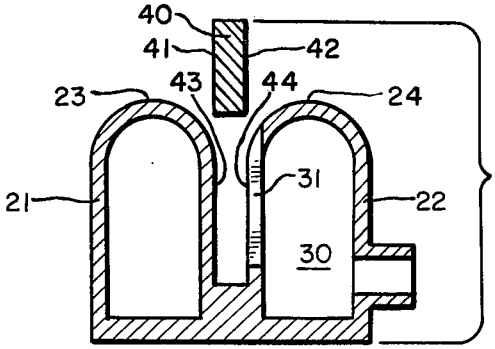

In accordance with the present invention, means including a movable member are provided for changing the cross-sectional profile of the groove to vary the included angle, that is, the degree of sharpness, of the bend as the sheet is acted upon by a substantially constant degree of the vacuum. The profile of the bend is preferably varied by interposing, in the root of the groove, a filler strip which is movable broadwise for changing the effective depth of the groove. This filler strip, indicated at 40, and which will be understood to extend the full width of the groove 25, has parallel lateral walls 41, 42 which slidably mate with parallel walls 43, 44 in the groove (see FIG. 1*a* ). As illustrated in FIG. 1, the device is adjusted for maximum correction. The sheet 11, which has a curling tendency as indicated at 11*a* in the upwardly convex direction, is drawn down into the groove 25 by the force of vacuum. Hence when the filler strip 40 occupies its lowest point in the groove, the sheet is drawn into the groove to maximum extent to produce a relatively sharp concave bend having an included angle $\alpha$ 1. It will be understood that as the sheet is transported in the direction of the arrow, the sheet is acted upon over its full length and width, being bent in the direction opposite to the direction of the curling tendency, so that the curling tendency is counteracted and the sheet tends to be restored to its original flat state for orderly depositing upon the delivery pile.

Where the curling tendency is less than that illustrated at 11*a* and in an amount indicated at 11*b* in FIG. 2, flatness may be restored by a more shallow bend. This is accomplished, in accordance with the invention, by raising the filler strip 40 as illustrated in FIG. 2 to reduce the effective sharpness of bend, hence the stress imparted to the sheet to a level corresponding to a larger included angle designated $\alpha$ 2. For adjusting the strip 40, and holding it at the level illustrated in FIG. 2, any suitable adjusting means, not shown but indicated at 45, may be employed, the only requirement being that the strip be raised parallel to itself that is, to an equal degree at each of its ends and held securely at the selected level. This is a matter well within the skill of the art.

It is one of the features of the construction that very small amounts of correction may be imparted to the sheet without reducing the vacuum to a level below which contact with the sheet becomes uncertain. Indeed, reliable contact between the sheet and the decurling device is maintained even where the filler strip is substantially level with the supporting surfaces, corresponding to zero, or near zero, correction.

In accordance with one of the aspects of the present invention, the downstream one of the supporting members has associated means for presenting an edge having a small radius of curvature over which the sheet is finally drawn to impart a convex bend to the sheet following the concave bend thereof to remove curling tendency in the opposite direction. More specifically, the filler strip 40 is elevatable into a position in which it extends clear of the groove and is provided with a presented edge having sufficient curvature so that when the sheet is drawn over the presented edge a final convex bend is imparted to the sheet thereby to remove curling tendency in the opposite or concave direction.

Figure 3:
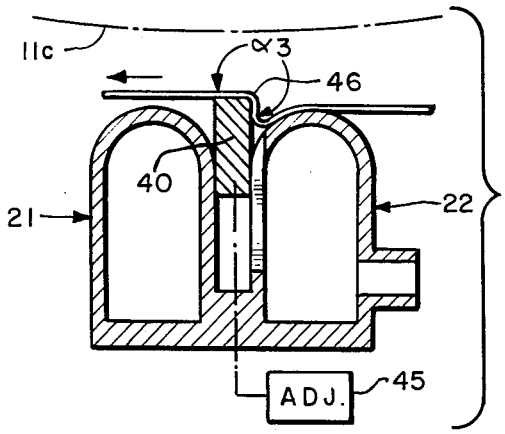
FIG. 3 is a view similar to FIGS. 1 and 2 but showing a device adjusted to produce a correction in the opposite direction.

Thus, referring to FIG. 3 of the drawings, and in which the sheet will be understood to have a concave set or curvature as indicated at 11*c*, the filler strip 40 is elevated, by the adjustment 45, so that it extends upwardly beyond the supporting surfaces 23, 24 of the adjacent supporting members. This causes the angle, indicated at $\alpha$ 3, to become substantially greater than 180°, as shown. The presented upstream facing edge, or corner, of the filler strip indicated at 46 is rounded with a small radius of curvature to impart a counteracting set to the sheet which is upwardly convex so that the sheet is restored from the condition illustrated at 11*c* to flat condition for depositing on the delivery pile. The degree of correction is dependent upon the amount of projection of the filler strip. It may be noted that the alternate types of correction are available by the simple expedient of shifting the filler strip, if desired, while the press is in operation.

Figure 4:
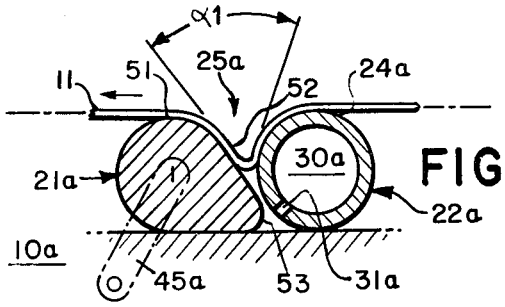
FIGS. 4, 5 and 6 show a cross-section taken through a modified form of the present invention in states corresponding respectively to FIGS. 1, 2 and 3.
Figure 5:
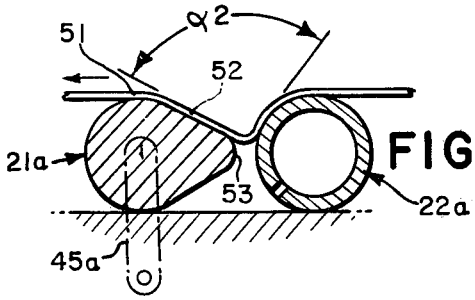
Figure 6:
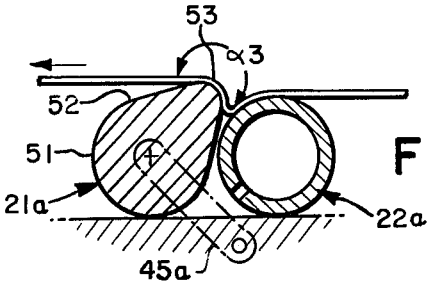

While the invention has been described above in connection with a preferred form, it will be understood that the invention may be practiced employing a rockable instead of a slidable element, as, for example, that illustrated in FIGS. 4, 5 and 6, in which corresponding portions of the device are represented by corresponding reference numerals with the addition of subscript *a*. Thus the decurling device, indicated generally at 10*a*, in FIG. 4 includes a downstream supporting member 21*a* and, spaced parallel to it, an upstream supporting member 22*a*, the latter having a supporting surface 24*a*. The two members define between them a transversely extending groove 25*a*. Vacuum is applied to the groove by making the member 22*a* hollow to form a vacuum plenum 30*a* having spaced ports 31*a* leading to the groove.

In accordance with the alternate form of the invention the function of the filler strip 40 is, instead, performed by making the supporting member 21*a* rockable about its longitudinal axis and by forming it with lobe portions of unlike curvature, with a movable member for moving a selected lobe portion into active position thereby to vary the profile of the groove. In the present instance, the downstream member 21*a* has a first portion, or lobe, 51, of the illustrated curvature, the second portion 52 of lesser curvature, and a third portion 53 of sharp curvature, the portions being brought into active position selectively by a mechanical operator generally illustrated, in dot-dash outline, as a positionable arm 45*a*.

During normal operation, in which a substantial degree of correction is to be imparted to the sheet, the device is adjusted to the condition illustrated in FIG. 4 in which the portion 51 serves primarily as the downstream supporting surface. With the vacuum acting upon the sheet the sheet is drawn down into the condition of relatively sharp bending at an included angle of $\alpha$1.

For a lesser degree of correction the supporting member 21*a* is angularly rocked in the counterclockwise direction so that the portion 52 serves as the supporting surface resulting in a lesser degree of bend, that is, a greater value of included angle, with the latter being illustrated at $\alpha$ 2.

To secure curling correction in the opposite direction, the supporting member is additionally rocked to bring the sharp portion, or lobe, 53 into active sheet engaging position as illustrated in FIG. 6. While the vacuum acts to hold the passing sheet in secure engagement with the decurling device, the sheet is drawn over the upraised and presented lobe 53 of the supporting member 21*a* where a final cnvex bend is applied to the sheet thereby to remove curling tendency in the concave direction, corresponding to 11*c* in FIG. 3.

It will be apparent from the above that the objects of the invention have been amply carried out. By changing the profile of the groove 25, either by use of a filler strip 40 or by means of a rockable supporting member having lobes of different curvature, the degree of curling correction, that is, the included angle of the bend made in the sheet, can be varied continuously and over relatively wide limits without having to vary the degree of vacuum, thereby permitting application of vacuum continuously at a sufficiently high level to insure that each sheet is fully engaged and acted upon, resulting in a higher degree of reliability, even where only slight curling correction is required. The device is simply constructed and easily installed regardless of the selected embodiment and may be quickly and accurately adjusted by relatively untrained personnel simply by observing the condition of the sheets deposited upon the stack and by making a corrective change at the adjusting member 45 in one direction or the other to achieve the desired degree of flatness.

What we claim is:

1. In a device for removing curling tendency in sheets in sheet-fed machines, particularly printing presses, having means for conveying a sheet edgewise in a transport plane, the combination comprising upstream and downstream beam-like supporting members arranged transversely with respect to the direction of sheet movement and presenting supporting surfaces which are spaced parallel to one another on one side of the transport plane to define a groove between them, means for applying vacuum within the groove to draw a passing sheet downwardly into the groove to produce a relatively sharp concave bend in the sheet thereby to counteract the curling tendency, and means including a movable member for changing the cross-sectional profile of the groove to vary the degree of sharpness of the bend.

2. The combination as claimed in claim 1 in which the movable member is in the form of a filler strip movable broadwise in the root of the groove for changing the effective depth of the groove and hence the sharpness of the included angle of the bend.

3. The combination as claimed in claim 1 in which the supporting members each are cylindrically crowned at a radius which is greater than the radius of the bend produced in the sheet.

4. The combination as claimed in claim 1 in which the downstream one of the supporting members has associated means for presenting an edge having a small radius of curvature over which the sheet is finally drawn to impart a relatively sharp convex bend to the sheet following the concave bend thereby to remove curling tendency in the opposite direction.

5. The combination as claimed in claim 2 in which the groove has parallel walls and in which the strip has parallel sides which are in slidable engagement with the walls in a direction into and out of the groove.

6. The combination as claimed in claim 1 in which at least one of the supporting members has cylindrical lobe portions of different curvature and in which the movable member is coupled to the one supporting member for changing the portion thereof which is presented to the sheet.

7. The combination as claimed in claim 1 in which the downstream one of the supporting members has angularly spaced lobe portions of unlike curvature and in which the movable member is effective to rock such supporting member about a longitudinal axis thereby to vary the profile of the groove.

8. The combination as claimed in claim 7 in which the downstream one of the supporting members has a lobe in the form of a relatively sharp edge presentable to the sheet and over which the sheet is drawn to impart a first convex bend to the sheet following the concave bend thereby to remove curling tendency in the opposite direction.

9. In a device for removing curling tendency in sheets in sheet-fed machines, particularly printing presses, having means for conveying a sheet edgewise in a transport plane, the combination comprising upstream and downstream beam-like supporting members arranged transversely with respect to the direction of sheet movement and presenting supporting surfaces which are spaced parallel to one another on one side of the transport plane to define a groove in between, means for applying vacuum within the groove to draw a passing sheet downwardly into the groove to produce a relatively sharp concave bend in the sheet thereby to counteract normal curling tendency, the supporting surfaces being cylindrically rounded to lead the sheet gradually into and out of the groove, a filler strip in the groove normally defining the bottom of the groove and which is adjustable broadwise for varying the depth of the groove, the filer strip being elevatable into a position in which it extends clear of the groove and having a presented edge with a small radius of curvature so that when the sheet is drawn over the presented edge a final convex bend is imparted to the sheet thereby to remove curling tendency in the opposite direction.

10. In a device for removing curling tendency in sheets in sheet-fed machines, particularly printing presses, having means for conveying a sheet edgewise in a transport plane, the combination comprising upstream and downstream beam-like supporting members arranged transversely with respect to the direction of sheet movement and presenting supporting surfaces which are spaced parallel to one another on one side of the transport plane to define a groove in between them, the upstream supporting member being hollow to form a vacuum plenum and having ports leading from the plenum into the groove, the plenum being connected to a source of vacuum for drawing a passing sheet downwardly into the groove to produce a relatively sharp concave bend in the sheet having a predetermined included angle to counteract the curling tendency, and means including a manually movable member for changing the profile of the groove to vary the sharpness of the included angle thereby varying the degree of correction while enabling the degree of vacuum to be kept substantially constant.

* * * * *